US007141788B2

(12) United States Patent
Hirabayashi et al.

(10) Patent No.: US 7,141,788 B2
(45) Date of Patent: Nov. 28, 2006

(54) ION SOURCE AND MASS SPECTROMETRIC APPARATUS

(75) Inventors: Atsumu Hirabayashi, Kodaira (JP); Yuichiro Hashimoto, Kokubunji (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/975,406

(22) Filed: Oct. 29, 2004

(65) Prior Publication Data

US 2005/0056781 A1 Mar. 17, 2005

Related U.S. Application Data

(63) Continuation of application No. 10/323,900, filed on Dec. 20, 2002, now abandoned.

(30) Foreign Application Priority Data

May 10, 2002 (JP) ..... 2002-134841

(51) Int. Cl.
*H01J 49/04* (2006.01)

(52) U.S. Cl. ..... 250/288

(58) Field of Classification Search ..... 250/288
See application file for complete search history.

(56) References Cited

U.S. PATENT DOCUMENTS

| | | | |
|---|---|---|---|
| 4,298,795 | A | 11/1981 | Takeuchi et al. |
| 5,306,412 | A | 4/1994 | Whitehouse et al. |
| 5,495,108 | A | 2/1996 | Apffel, Jr. et al. |
| 5,756,994 | A | 5/1998 | Bajic |
| 5,898,175 | A | 4/1999 | Hirabayashi et al. |
| 6,032,876 | A | 3/2000 | Bertsch et al. |
| 6,114,693 | A | 9/2000 | Hirabayashi et al. |

(Continued)

FOREIGN PATENT DOCUMENTS

| | | |
|---|---|---|
| JP | 9-257751 | 3/1996 |

(Continued)

OTHER PUBLICATIONS

John B. Fenn, Matthias Mann, Chin Kai Meng, Shek Fu Wong, Craig M. Whitehouse, "Electrospray Ionization for Mass Spectrometry of Large Biomolecules", Science, vol. 246 (Oct. 1989), pp. 64-71.

(Continued)

*Primary Examiner*—Nikita Wells
*Assistant Examiner*—James P. Hughes
(74) *Attorney, Agent, or Firm*—Reed Smith LLP; Stanley P. Fisher, Esq.; Juan Carlos A. Marquez, Esq.

(57) ABSTRACT

A mass spectrometric apparatus of high sensitivity, including a spray ionization interface suitable for the ionization of a low flow-rate liquid that prevents charged particles from being introduced into a vacuum device; wherein the ion source comprises a capillary having a first end having an inner diameter that gradually reduces in size in the direction of gas flow and wherein a liquid sample is introduced into an opposite second end of the capillary; a gas guide tube which guides gas flow along an outer periphery of the first end the capillary and which sprays the liquid sample from the first end of the capillary; and a gas introducing section for introducing the gas into the gas guide tube. A first end of the gas guide tube has a reduced inside diameter and receives the first end of the capillary in a holding member. Gaseous ions produced are introduced into a vacuum section through an ion intake port and are subjected to mass separation by a mass spectrometer. The angle between the central axis of the capillary and that of the ion intake port is greater than about 15°.

18 Claims, 7 Drawing Sheets

U.S. PATENT DOCUMENTS

| | | | | |
|---|---|---|---|---|
| 6,127,680 | A | 10/2000 | Andrien, Jr. et al. | |
| 6,147,347 | A | 11/2000 | Hirabayashi et al. | |
| 6,326,616 | B1 | 12/2001 | Andrien, Jr. et al. | |
| 6,337,480 | B1 | 1/2002 | Andrien, Jr. et al. | |
| 2002/0125426 | A1 | 9/2002 | Hirabayashi et al. | |
| 2003/0189170 | A1 | 10/2003 | Covey et al. | |
| 2006/0132068 | A1* | 6/2006 | Norling et al. | 315/502 |

FOREIGN PATENT DOCUMENTS

| | | |
|---|---|---|
| JP | 11-108896 | 7/1998 |
| JP | 2000-131280 | 10/1998 |
| JP | 11-281622 | 1/1999 |

OTHER PUBLICATIONS

"Comparison of Parallel Flow and Vertical Flow in Electrospray, ion Spray", Annual Conference on Mass Spectrometry (May 16, 1995), Abstract and p. 36.

Atsumu Hirabayashi, Yukiko Hirabayashi, Minoru Sakairi and Hideaki Koizumi, "Multiply-Charged Ion Formation by Sonic Spray", Rapid Communications in Mass Spectrometry, vol. 10, (1996), pp. 1703-1705.

N. Rajaratnum "Turburent Jets", Chapter 6-Axisymmetric Shear Layers, Morikita Shuppan Co. Ltd., pp. 109-115.

* cited by examiner

ION SOURCE AND MASS SPECTROMETRIC APPARATUS

This application is a Continuation application of U.S. application No. Ser. 10/323,900 filed on Dec. 20, 2002 now abandoned. Priority is claimed based on U.S. application No. Ser. 10/323,900 filed on Dec. 20, 2002, which claims priority to Japanese Patent Application No. 2002-134841 filed on May 10, 2002.

BACKGROUND OF THE INVENTION

1. Field of the Invention

The present invention relates to an analyzer for a trace biosubstance and, more particularly, to a mass spectrometer suitable for proteomics which analyzes proteins in a comprehensive manner.

2. Description of Related Art

Heretofore, in high-sensitivity mass spectrometry for trace biosubstances, there widely has been used an electrospray ionization (ESI) mass spectrometry. The details of ESI which produces gaseous ions is described in Science, Vol. 246, pp. 64–71, 1989. In the conventional ESI, a sample solution is introduced into a metallic capillary about 0.2 mm in outside diameter and a high electric field is applied to the sample solution at an end portion of the capillary. As a result, with the high electric field, the sample solution is withdrawn from the capillary end portion and a liquid cone is formed. At a tip portion of the cone, ions of the same polarity are concentrated, so that a repulsive force between ions increases to a level equal to the surface tension of liquid and charged droplets are discharged from the cone tip which has become unstable. The charged droplets thus produced evaporate and release gaseous ions. The gaseous ions thus generated are introduced into a vacuum device and are analyzed by means of a mass spectrometer.

Further, as described in Book of Abstracts, Annual Conference on Mass Spectrometry, the Mass Spectrometry Society of Japan, pp. 36–37 (1995), there has been proposed a structure in which a central axis of a capillary and that of an ion intake port in a mass spectrometer are made substantially orthogonal to each other. According to this technique, it is possible to somewhat eliminate charged particles and introduce only gaseous ions preferentially into a vacuum device.

Generally, in ESI, the ion producing efficiency tends to become higher as the flow rate of a sample solution decreases. However, if the flow rate of a sample solution is not higher than 1 μL/min (microliter/min) the evaporation of solvent from a liquid cone becomes too high, with the result that the production of ions becomes unstable or the ion producing efficiency becomes lower with the lapse of time. In view of this point, there has been developed a nanospray chip made of quartz wherein only a capillary end is formed as small as several μm to 10 μm. In this miniaturized ESI, since the solvent evaporation effect becomes lower, ions can be produced stably in such an extremely low flow rate range of a sample solution from 1 μL/min to 1 nL/min (nanoliter/min).

Moreover, since the flow rate of a sample solution is low, the size of the resulting charged droplet also becomes small, with consequent improvement of the ion producing efficiency. For this reason, a nanospray is often used at present for protein analysis. In many cases, a central axis of a capillary is aligned with that of an ion intake port in a mass spectrometer.

On the other hand, as an extremely soft ionization method there has been developed a sonic spray ionization method (SSI) which produces gaseous ions by spraying a sample solution together with a high-speed current of gas, e.g. sonic gas current, from a capillary end as described in U.S. Pat. No. 6,147,347 and U.S. Pat. No. 6,114,693. According to SSI, with a shear force induced by a sonic gas current, charged fine droplets are produced from a sample solution and gaseous ions are generated efficiently. The ion producing efficiency tends to increase with a decrease of liquid flow rate.

In SSI, however, a quartz capillary having an outside diameter of about 200 μm and a flow rate of above 10 μL/min have so far been used in many cases. This is because if the capillary is used at a flow rate of below 10 μL/min; the suction of liquid by a sonic gas current becomes too high at the capillary end and it becomes difficult to stabilize the production of ions. If the flow velocity of gas is low, the liquid suction effect becomes low, but the size of a droplet formed by spray becomes large and, therefore, the ionization efficiency is not high.

In the case where a mixed solution containing trace biosubstances extracted from a living body is separated by liquid chromatography (LC), the liquid flow rate is lower and the separation is expected to be higher. For this reason, in a liquid chromatography/mass spectrometry (LC/MS) system it is desirable to decrease the liquid flow rate in LC. In LC/MS interface or ion producing section, the ion producing efficiency tends to becomes higher as the liquid flow rate becomes lower. Therefore, decreasing the liquid flow rate is important in high-sensitivity analysis of trace biosubstances.

A non-volatile substance comprising an impurity is certain to be mixed in a charged droplet produced by spray. Therefore, after evaporation of a volatile solvent, the charged droplet remains as a charged particle. If this charged particle is introduced, together with ion, into a vacuum device, not only is the mass spectrometer contaminated, but also it becomes a noise source in ion detection, thus making peak determination difficult.

SUMMARY OF THE INVENTION

The present invention provides as an ion source a spray ionization interface suitable for the ionization of a low flow rate liquid and also provides a mass spectrometer of high sensitivity which can analyze at high speed and high sensitivity a mixed solution containing trace biosubstances extracted from a living body and which is suitable for proteomics for analyzing proteins in a comprehensive manner.

A preferred aspect of the present invention is directed to an ion source that comprises a capillary into which a liquid sample is introduced, a gas guide tube into which one end side of the capillary is inserted, and a gas introducing section for introducing gas into the gas guide tube. The capillary is formed so that its outside diameter and inside diameter gradually become smaller toward a first end. A liquid sample is introduced into the capillary from an opposite, second end. Gas is allowed to flow along an outer periphery along the first end of the capillary and the liquid sample is sprayed therefrom. The second end of the capillary is inserted into the gas guide tube. The inside diameter of the gas guide tube is formed so as to become smaller toward the first end of the capillary. The preferred shape of the capillary tube whose inside diameter gradually becomes smaller towards the first end thereof provides a stable spray of ions, since the suction of liquid by a sonic gas current is negligible. In addition, ion formation is highly efficient due to the very high charge density of the solution near the tip of the capillary's first end, which has the graduated inside diameter.

The capillary is held by a capillary holding member disposed between a position near the first end of the capillary and the gas guide tube. The first end of the capillary is inserted into a tapered hole defined by the capillary holding member.

In another preferred aspect, a mass spectrometer of the present invention comprises the above-described ion source and a mass spectrometer, the mass spectrometer introducing ions produced by the ion source from an ion intake port and conducting mass separation. The ion intake port is disposed outside a conical beam of charged particles generated from the ion source, thereby preventing the charged particles from being introduced from the ion intake port into a vacuum device. More specifically, there is adopted a construction wherein a central axis of the capillary and that of the ion intake port are rendered approximately orthogonal to each other or a construction wherein the one end of the capillary lies on the central axis of the ion intake port. Further, the ion intake port is disposed outside a conical beam of charged particles emanating from the first end of the capillary and which has a vertical angle of 15° relative to the central axis of the capillary.

According to this preferred aspect of the present invention, charged particles produced by the spray of a liquid sample are prevented from being introduced into the vacuum device, whereby the contamination of electrodes, etc. in the interior of the vacuum device is prevented and hence it is possible to prevent the occurrence of spike noises caused by charged particles.

Other and further objects, features and advantages of the invention will appear more fully from the following description.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

Figure 1:
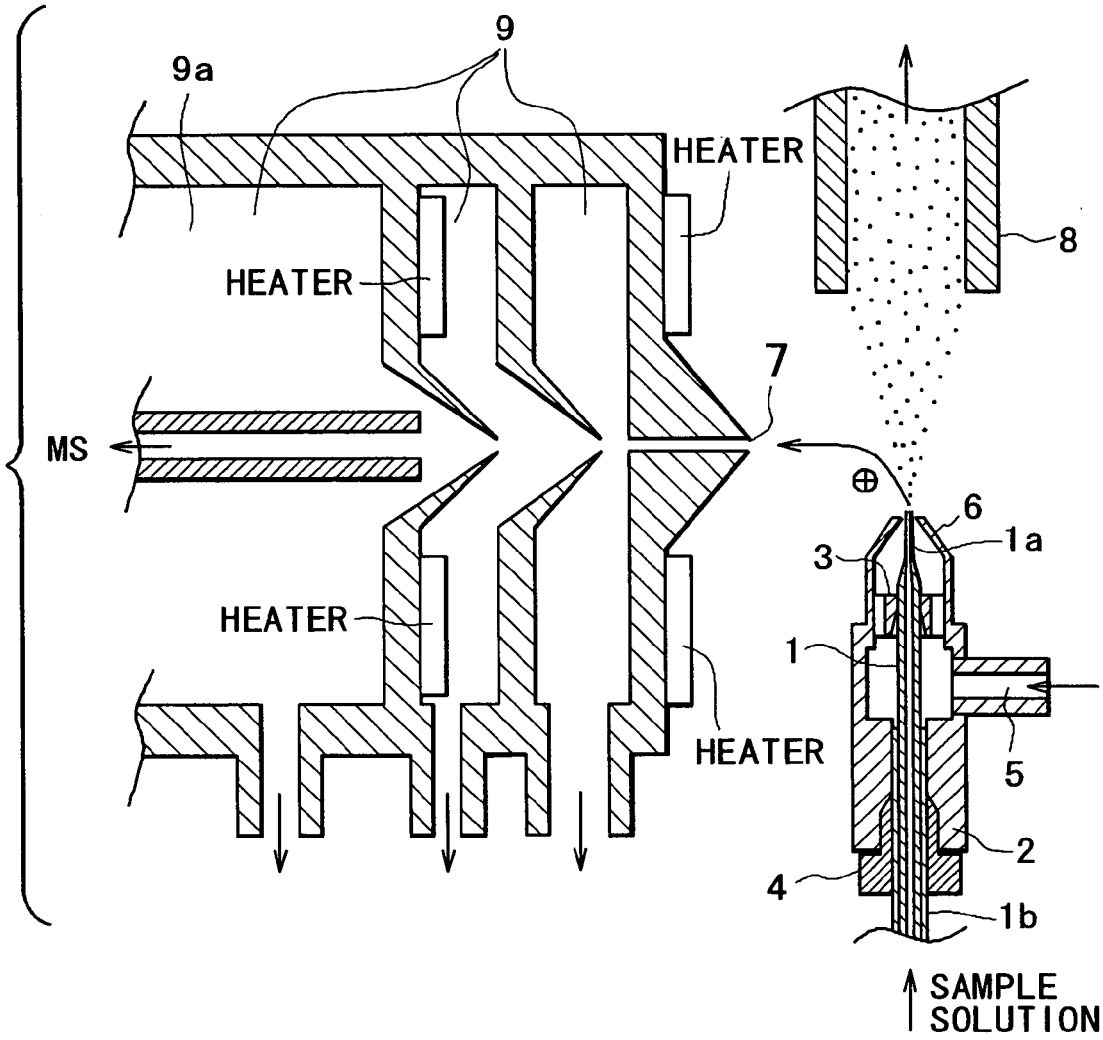
FIG. 1 is a cross-sectional view showing a principal portion of a preferred embodiment of a mass spectrometer of the present invention.

It is to be understood that the figures and descriptions of the present invention have been simplified to illustrate elements that are relevant for a clear understanding of the present invention, while eliminating, for purposes of clarity, other elements that may be well known. Those of ordinary skill in the art will recognize that other elements are desirable and/or required in order to implement the present invention. However, because such elements are well known in the art, and because they do not facilitate a better understanding of the present invention, a discussion of such elements is not provided herein. The detailed description will be provided herein below with reference to the attached drawings.

A mass spectrometer embodying the invention is described below, the mass spectrometer using as an ion source a spray ionization interface including a capillary which has a first end of gradually reduced outside and inside diameters and an interface having a structure for introducing as many charged particles as possible into the air and for introducing as many gaseous ions as possible into a vacuum device.

In a preferred ion source of the present invention, the capillary comprises a first end of gradually reduced outside and inside diameters and an opposite, second end, into which a liquid sample is introduced. The graduate first end of the capillary is inserted into a gas guide tube and gas is introduced into the gas guide tube from a gas introducing section. The gas is allowed to flow along an outer periphery of the first end of the capillary and the liquid sample is sprayed from the first end of the capillary. The end of the gas guide tube that receives the first end of the capillary is also reduced in inside diameter.

In a preferred ion source used in the mass spectrometer according to the present invention, the length in the gas flowing direction of a tip portion of the gas guide tube, which is the smallest portion in inside diameter of the gas guide tube, is in the range of 0.1 to 2 mm. The pressure of gas in a gas supply section for the supply of gas to the gas introducing section is set at a value in the range of 2 to 10 atmospheres. The value of a parameter F/S is in the range of 350 to 1000 m/s, the parameter F/S being determined by both a cross section S of the gas flow orthogonal to the gas flowing direction of the tip portion of the gas guide tube (smallest portion in inside diameter) and a flow rate F (in terms of a flow rate in a standard state) of the gas which is fed to the gas introducing section from the gas supply section. A gas pressure gauge is used for measuring the pressure of gas fed from the gas supply section to the gas introducing section. Further, there is disposed a gas flow controller or gas valve for controlling the flow rate or pressure of the gas fed from the gas supply section to the gas introducing section.

A preferred mass spectrometer of the present invention is described below with reference to FIG. 1. The ion source comprises a capillary 1 having a first end 1*a* having gradually reduced outside and inside diameters and an opposite, second end 1*b*, into which a liquid sample is introduced. A gas guide tube 6 which guides gas to flow along an outer periphery of the first end 1*a* of the capillary and which sprays the liquid sample from the first end 1*a*. A gas introducing section 5 allows gas to be introduced into the gas guide tube 6. Gaseous ions produced are introduced into a vacuum section 9 through an ion intake port 7 and are subjected to mass separation by means of a mass spectrometer. The capillary 1 is fixed at a position near the first end 1*a* to the interior of the gas guide tube 2 by means of a holding member 3 and is fixed on the second end 1*b* to an ion source housing through a plug 4. Charged particles are discharged to the exterior through a suction port 8. The ion intake port 7 is disposed outside a conical beam of charged particles generated from the ion source to prevent the charged particles from being introduced into a vacuum device through the ion intake port. The mass spectrometer of this preferred construction has high sensitivity and includes a spray ionization interface suitable for the ionization of a low flow rate liquid.

FIG. 1 is a sectional view showing an example of a principal portion of a mass spectrometer according to a preferred embodiment of the present invention. A sample solution is introduced into the graduated first end 1*a* of the capillary 1. Gas (dry air or dry nitrogen) is introduced into the ion source housing 2 through a gas inlet port 5. The gas is jetted to the exterior from between an inner surface of the gas guide tube 6 and an outer surface of the first end 1*a* of the capillary 1. A gap for the passage of gas is formed in the holding member 3, whereby the gas introduced through the gas inlet port 5 is prevented from being decreased in pressure by the holding member 3.

With the above preferred construction, a substantially sonic gas flow can be formed at the first end 1*a* of the capillary 1 and gaseous ions are produced efficiently from the sample solution by the high-speed spray of gas. The preferred graduated shape of the first end 1*a*, the inside diameter of that gradually becomes smaller towards the tip thereof, provides a stable spray of ions. This is because the suction of liquid by a high gas current becomes low enough at the capillary tip. In addition, the ion formation is highly efficient due to the very high charge density of the solution near the graduated tip 1*a*. Gaseous ions produced under the atmospheric pressure are introduced into a vacuum section 9 through an ion intake port 7. The vacuum section 9 comprises a plurality of chambers, each different in the degree of vacuum, which chambers are exhausted in a differential manner. The chamber 9*a* located at the leftmost position in FIG. 1 has the highest in the degree of vacuum, in which a mass spectrometer (MS) is installed.

Since a non-volatile substance is contained, even a little, in the sample solution, it is impossible to expect a complete conversion of spray-produced charged droplets into gaseous molecules or ions. That is, charged particles are lastly produced. If the charged particles are introduced into the vacuum section 9 through the ion intake port 7 in the mass spectrometer, various electrodes and fine holes are stained and ion focusing becomes incomplete, thus causing lowering of the ion detecting sensitivity.

For preventing the charged particles from being introduced into the vacuum section 9 through the ion intake port 7 in the mass spectrometer, a central axis of the capillary 1 and that of the ion intake port 7 preferably are made substantially orthogonal to each other, as shown in FIG. 1.

In such a structure, by applying an external electric field toward the ion intake port 7, the gaseous ions and the charged particles can be separated from each other by utilizing the difference in the degree of easiness of movement and only the gaseous ions are introduced into the ion intake port 7, while the charged particles can be excluded to the exterior through a suction port 8.

By applying a voltage of 2 kV or so between the ion intake port 7 and the sample solution introduced into the capillary 1, it is possible to improve the ion producing efficiency and the resulting gaseous ions can be focused to the ion intake port 7 effectively by an electric field.

Figure 2:
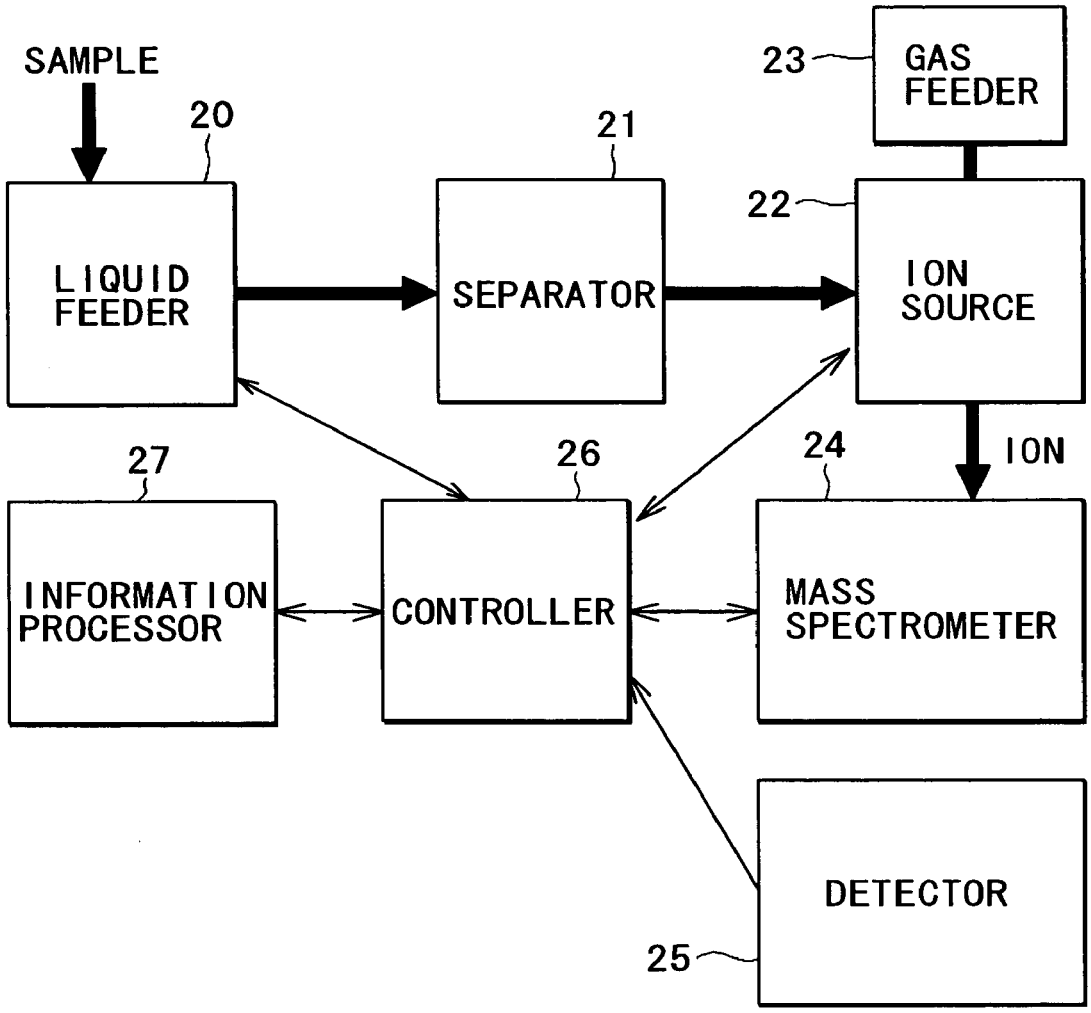
FIG. 2 is a block diagram showing a flow chart with respect to a preferred embodiment of a mass spectrometer of the present invention.

FIG. 2 is a block diagram showing a preferred example of a sample analysis flow using the mass spectrometer of this first preferred embodiment. A sample is introduced into a liquid feeder 20, then is subjected to separation in a separator 21, such as a liquid chromatograph, and is thereafter introduced into an ion source 22. Gas (dry air or dry nitrogen) is introduced from a gas feeder 23 into the ion source 22 at a predetermined constant pressure or constant flow rate. Gaseous ions produced in the ion source 22 are introduced into a mass spectrometer 24, in which mass separation is performed, followed by detection in a detector 25. An output of the detector 25 is transmitted to a controller 26 and then to an information processor 27 for data processing. The controller 26 controls the liquid feeder 20, ion source 22 and mass spectrometer 24.

Figure 3:
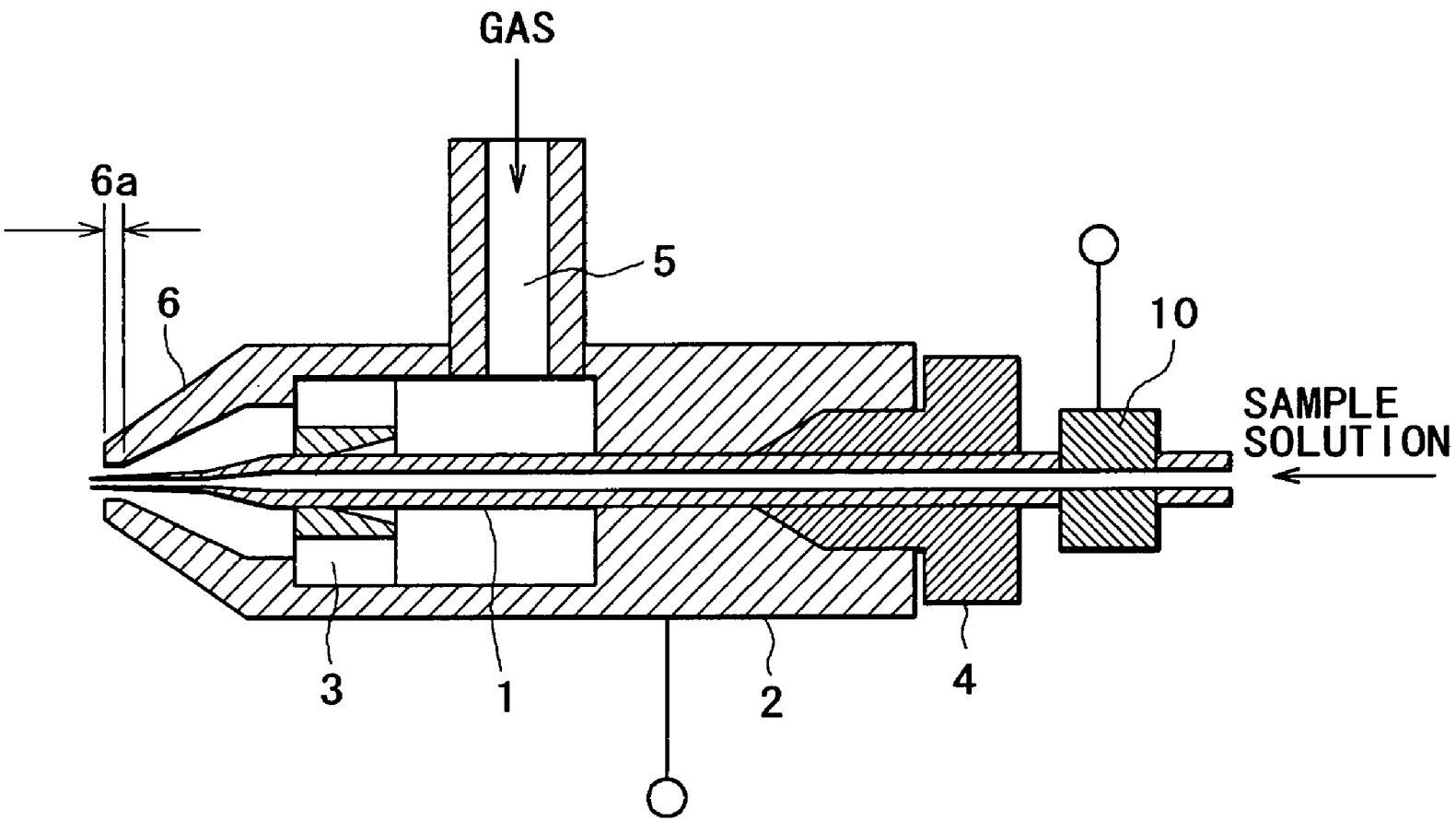
FIG. 3 is a cross-sectional view of a preferred embodiment of an ion source of the present invention.

FIG. 3 is a cross-sectional view showing a constructional example of the ion source used in this first preferred embodiment.

A sample solution 10 is introduced at a low flow rate of not higher than 10 μL/min into a quartz capillary 1 which is reduced in both outside and inside diameters at the first end 1*a* thereof. The capillary 1 is fixed to an ion source housing 2 by means of a holding member 3 and a plug 4. Gas (dry air or dry nitrogen) is introduced into the ion source housing 2 through a gas inlet port 5 and is jetted to the exterior from between an inner surface of a gas guide tube 6 and an outer surface of the one end of the capillary 1. A gap for the passage of gas is formed in the holding member 3, whereby the gas introduced through the gas inlet port 5 is prevented from undergoing a pressure drop by the holding member 3.

The first end 1*a* of the quartz capillary 1 is very likely to break and the holding member 3 prevents it from contacting the gas guide tube 6 to prevent breakage thereof. This is important particularly when assembling the ion source. The holding member 3 is tapered on the inserting side of capillary 1. With an electrode 10, which comes into contact with the sample solution, it is possible to apply voltage to the sample solution. As to the electrode 10, even if a metallic film is formed outside the second end 1*b* of the capillary 1 by sputtering of a conductor, such as gold, and is rendered conductive with the solution at the second end 1*b*, no problems occur.

From the standpoint of ion producing efficiency, it is desirable that the first end 1*a* of the quartz capillary 1 extends about 0 to 0.2 mm beyond the end of the gas guide tube 6. This is to expose the sample solution to the high-speed gas flow, which is accelerated by adiabatic expansion, resulting in fine charged droplets being produced from the sample solution and a large amount of gaseous ions being produced. Actually, if the first end 1*a* of the capillary 1 is extended 2 mm or more beyond the end of the gas guide tube 6, the amount of ions produced becomes very large.

On the other hand, if the first end 1*a* of the quartz capillary 1 is positioned 0.5 mm or so inside the end of the gas guide tube 6, the amount of ions produced becomes small. This is because the sample solution is not directly exposed to the accelerated high-speed gas flow and therefore charged droplets do not become small in size.

Because the inside diameter of the capillary 1 at end 1*a* gradually becomes smaller toward the tip, the sample solution withdrawing effect by the high-speed gas flow is lower and the production of ions becomes more stable, even at a low flow rate. For example, if the inside diameter of the first end 1*a* of the capillary 1 is 100 μm, it is difficult to effect a stable production of ions at a flow rate of the solution of 1

μL/min or less. However, if the inside diameter of the first end 1*a* is 5 μm, stable ion production is obtained at 100 nL/min.

The higher the gas flow velocity is through guide tube 6, the smaller the size of charged droplets produced by gas spray becomes and the ion producing efficiency is improved. However, if the gas flow velocity lies in the supersonic range, the size of charged droplets increases due to the formation of a shock wave. For this reason, the finest charged droplet is formed when the gas flow velocity is almost equal to the sonic velocity. As described in U.S. Pat. No. 6,147,347, the gas flow velocity at the first end 1*a* of the capillary 1 becomes almost equal to the sonic velocity in the case where the value of a parameter F/S is in the range of 350 to 1000 m/s, the parameter F/S being determined by both a cross section S of the gas flow orthogonal to the gas flow direction of a portion smallest in inside diameter of the gas guide tube 6 and a flow rate F (in terms of a flow rate in a standard state) of the gas introduced into the ion source housing 2 from the gas inlet port 5. (Since the gas flow is a compressible fluid, the parameter F/S is of the same dimension as velocity, but is different from gas velocity.)

The higher the pressure of the gas introduced into the ion source housing 2, the higher the flow velocity of gas jetted to the exterior (for example into the air) from the end of the gas guide tube 6. If the axial length 6*a* of the smallest inside diameter portion at the end of the gas guide tube 6 is zero ideally, it is possible to assume an isoentropic flow and the following equation is established (Takefumi IKUI and Kazuyasu MATSUO, "Dynamics of Compressible Fluids," Riko-Gaku-Sha, Tokyo, 1977):

$$P_0/P=\{1+(k-1)M^2/2\}^{k/(k-1)}$$

where $P_0$, P, k, and M stand for the pressure of gas introduced into the ion source housing 2, the pressure of gas around the ion source housing 2, specific heat ratio of gas, and Mach number, respectively. Where it is nitrogen gas or air that is introduced, k=1.4. In the case of P=1 atm., it is estimated that the pressure $P_0$ of gas introduced from the gas inlet port 5 into the ion source housing 2 is required to be 1.8929 atm. for forming a sonic gas flow (M=1).

Actually, since the length 6*a* in the axial direction of the smallest inside diameter portion at the end of the gas guide tube 6 is not negligible, there arises the necessity of taking pressure loss into consideration and a higher gas pressure $P_0$ is required in comparison with the case of an isoentropic flow. However, when the pressure resistance of piping and cost are taken into account, it is not practical to supply a gas pressure of above 10 atm. from the gas feeder.

But if the axial length 6*a* of the smallest inside diameter portion at the end of the gas guide tube 6 is 2 mm or so, a sonic gas flow can be formed at a gas pressure in the gas feeder of 5 atm. or less. Further, if the said axial length 6*a* is 0.1 mm, pressure loss is almost ignored and a sonic gas flow is formed at a gas pressure of about 2.1 atm. The shorter is the axial length 6*a* of the smallest inside diameter portion at the end of the gas guide tube 6, the greater is the degree of decrease in pressure loss and the gas flow approaches an isoentropic flow. From the standpoint of a physical strength it is practical that the axial length 6*a* of the smallest inside diameter portion at the end of the gas guide tube 6 lies in the range of about 0.1 to 2 mm. In this case, if the gas pressure in the gas feeder is in the range of 2 to 10 atm., it will be possible to attain a high ion producing efficiency.

Figure 4A:
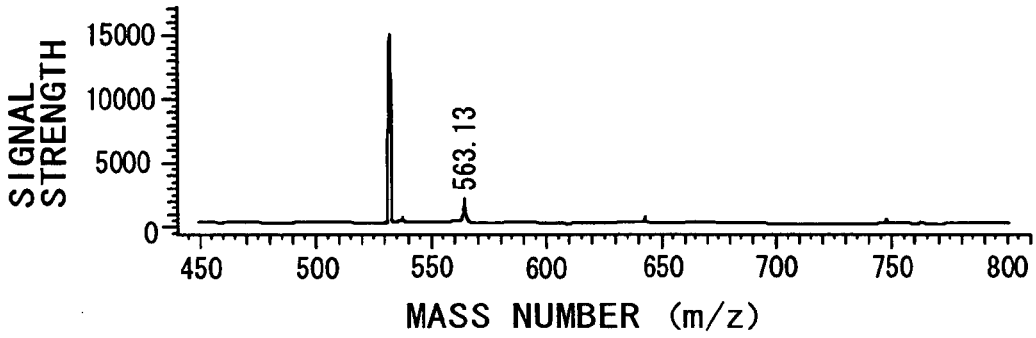
FIGS. 4A, 4B and 4C are diagrams showing examples of mass spectra obtained by using a preferred embodiment of an ion source of the present invention.
Figure 4B:
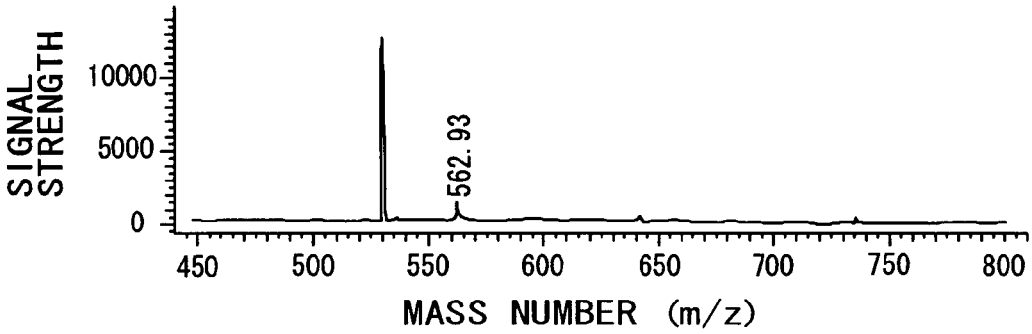
Figure 4C:
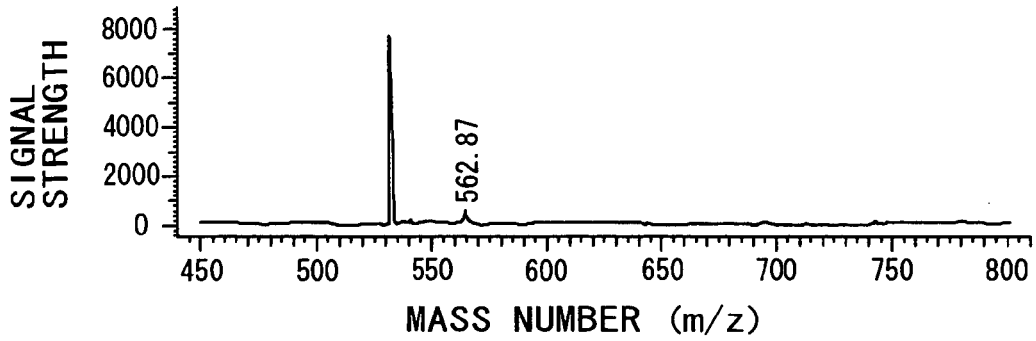

FIGS. 4A, 4B and 4C show examples of mass spectra obtained by using the ion source of this preferred embodiment. The sample solution used is a bradykinin solution having a concentration of 1 μM (micromole) (solvent: formic acid/acetronitrile/water=0.1/50/50%, v/v/v). The sample solution was introduced into the capillary 1 at a constant flow rate with use of a syringe pump.

FIGS. 4(A), 4(B), and 4(C) represent mass spectra obtained at liquid flow rates of 1, 0.3, and 0.1 μL/min, respectively. There was detected a bradykinin molecule with two protons added to mass number m/z=531. It is seen that the ionic strength detected is having a low liquid flow rate dependence.

The outside diameter at the first end 1*a* of the-quartz capillary 1 in the ion source used is about 15 μm and the inside diameter and axial length 6*a* of the end portion of the gas guide tube 6 are 0.4 mm and 0.1 mm, respectively. By adjusting the gas pressure to about 2.1 atm. by means of a needle valve equipped with a pressure gauge and by introducing nitrogen gas into the gas inlet port 5 there was realized a sonic gas flow spray. The distance between the capillary 1 and the ion intake port 7 is about 3 mm and as the mass spectrometer there was used a Hitachi M-8000 quadrupole ion trap mass spectrometer. In this case, voltages of −1.5 kV and 0 V were applied, respectively, to the gas guide tube 6 and the electrode 10, which contacted the sample solution. The axis of the capillary 1 and that of the ion intake port 7 were approximately aligned with each other.

The method for the application of voltage is as described in the publication Rapid Communication in Mass Spectrometry, v. 10, p. 1703 (1996). Even if a voltage of about +2.3 kV is applied to both gas guide tube 6 and electrode 10 contacting the sample solution, the same result obtained. Even if no voltage is applied to the gas guide tube 6, ions are produced in many cases, but reproducibility may be deteriorated.

Figure 5:
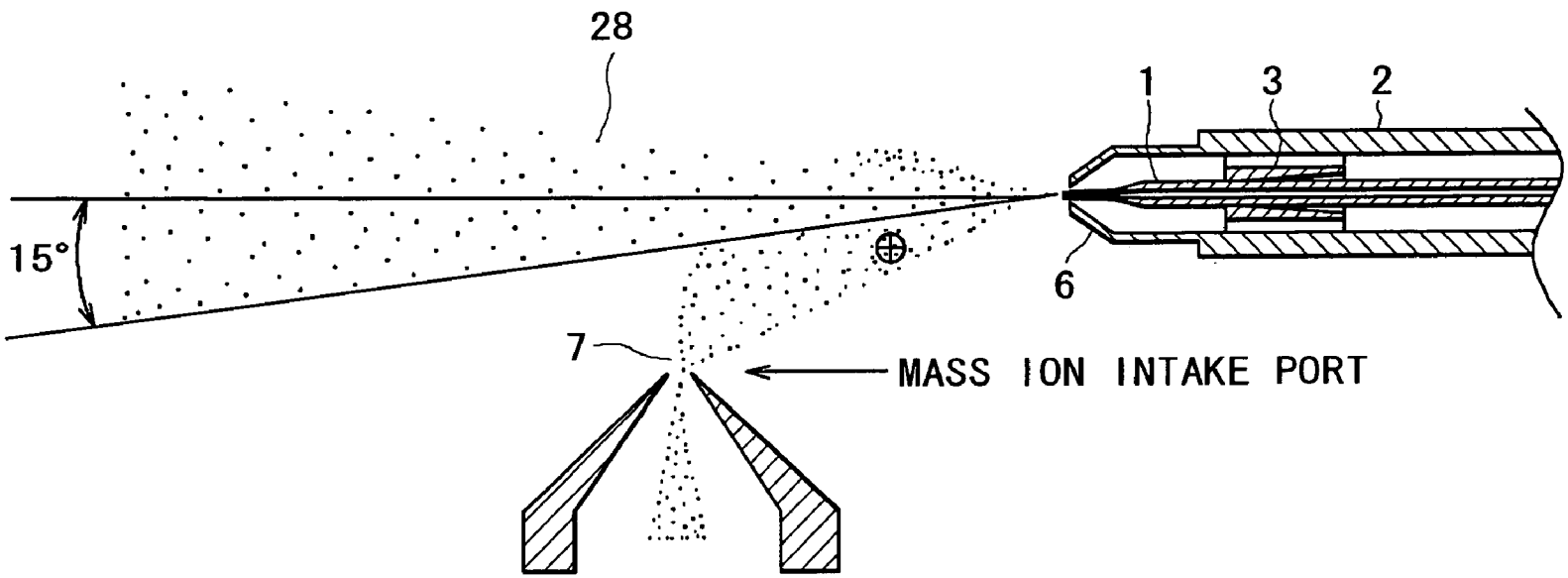
FIG. 5 is a cross-sectional view of the ion source and the vicinity thereof in a preferred embodiment of the mass spectrometer of the present invention, explaining a principle of removing charged particles.

FIG. 5 is a cross-sectional view of the ion source and the vicinity thereof in a preferred mass spectrometer of the present invention, explaining a principle of removing charged particles. Charged droplets produced by gas spray from the graduated first end 1*a* of the capillary 1 in the ion source generate gaseous ions with evaporation of solvent molecules.

However, since a non-volatile substance is often contained in droplets during formation of charged droplets, the charged droplets produced by spray are not completely gasified but become charged particles of 10 nm or so. Such charged particles tend to advance straight together with gas flow.

As a result of photographing it was observed that there was formed a conical beam 28 including the first end 1*a* of the capillary 1 as a vertex and having a specific angle (vertical angle) (15°) relative to the axis of the capillary 1, as shown schematically in FIG. 5. This specific angle (vertical angle) is estimated at 9.5° in the case of a jet from a circular nozzle ("Turbulent Jets," written by N. Rajaratnum, translated by Yasumasa NOMURA, published by Morikita Shuppan Co., Ltd.), but in the case of a jet from an orifice it is understood that the specific angle is enlarged to 15° because the mixing with surrounding gas is promoted in comparison with the jet from a circular nozzle.

If the charged particles are introduced into the vacuum device through the ion intake port 7, various electrodes will be stained, causing an obstacle to ion focusing. This means that more frequent maintenance such as cleaning is required. In the case where the charged particles are detected directly by the detector, they are detected as random spike noises, thus causing deterioration of the sensitivity.

As shown in FIGS. 1 and 5, for making the axis of the capillary 1 and that of the ion intake port 7 substantially orthogonal to each other, the ion intake port 7 is disposed outside the conical beam 28 of the charged particles, whereby it is possible to prevent the charged particles from being introduced into the vacuum device through the ion intake port 7. Under this condition it becomes possible to not only diminish the maintenance work for the mass spectrometer but also effect high sensitivity ion detection.

Figure 6:
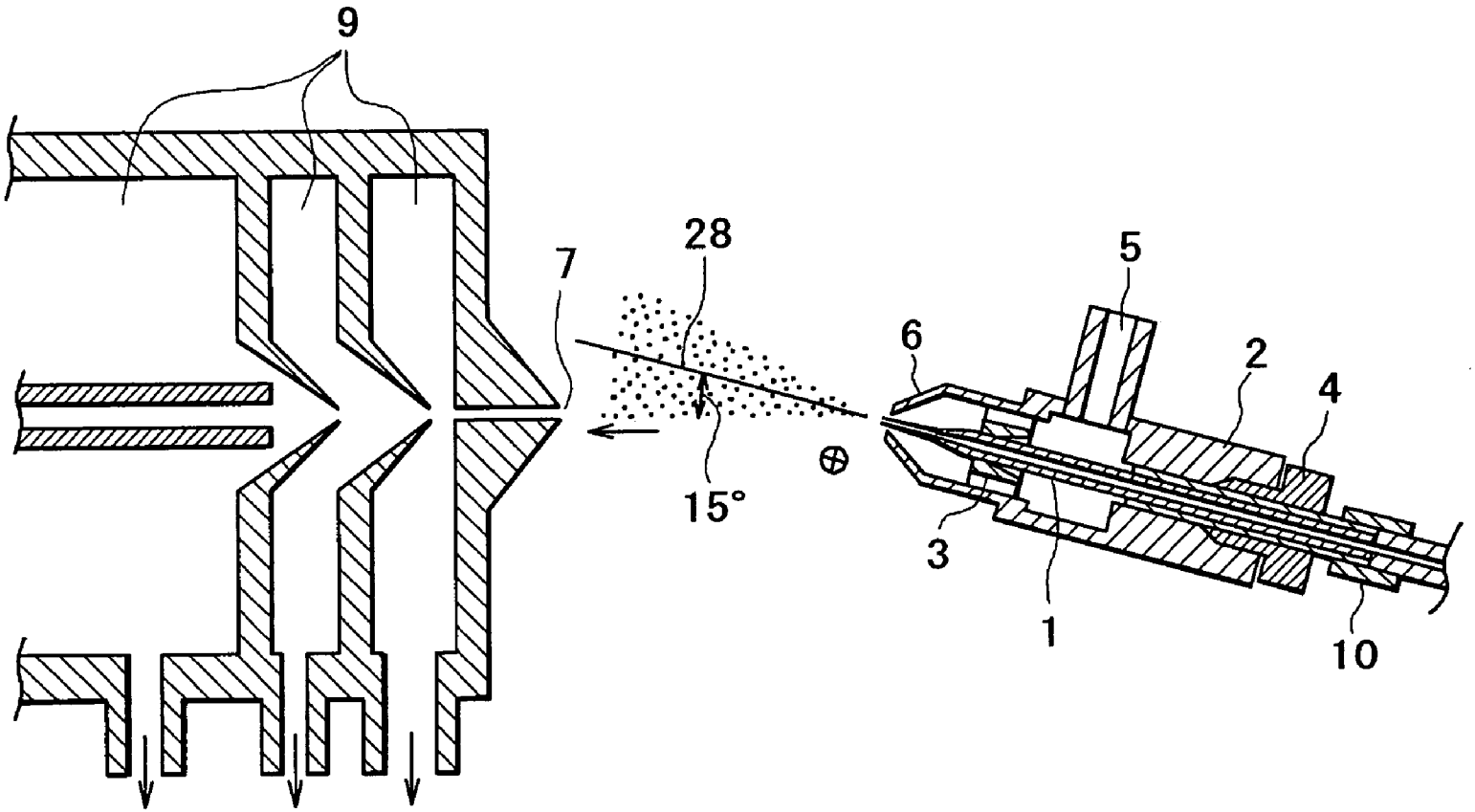
FIG. 6 is a cross-sectional view of the ion source and the vicinity thereof in a preferred embodiment of the mass spectrometer of the present invention, explaining a principle of removing charged particles.

FIG. 6 is a cross-sectional view of the ion source and the vicinity thereof in a preferred mass spectrometer of the present invention, explaining a principle of removing charged particles. With the construction shown in FIG. 6, charged particles are prevented from being introduced into the vacuum device through the ion intake port 7. When the angle between the central axis of the capillary 1 and the central axis of the ion intake port 7 is about 15° or less, charged particles are introduced directly into the vacuum device through the ion intake port 7. For this reason, the angle between the capillary axis and the axis of the ion intake port 7 preferably is set at about 15° or larger, and more preferably is set at greater than about 15° but less than about 130°.

Figure 7:
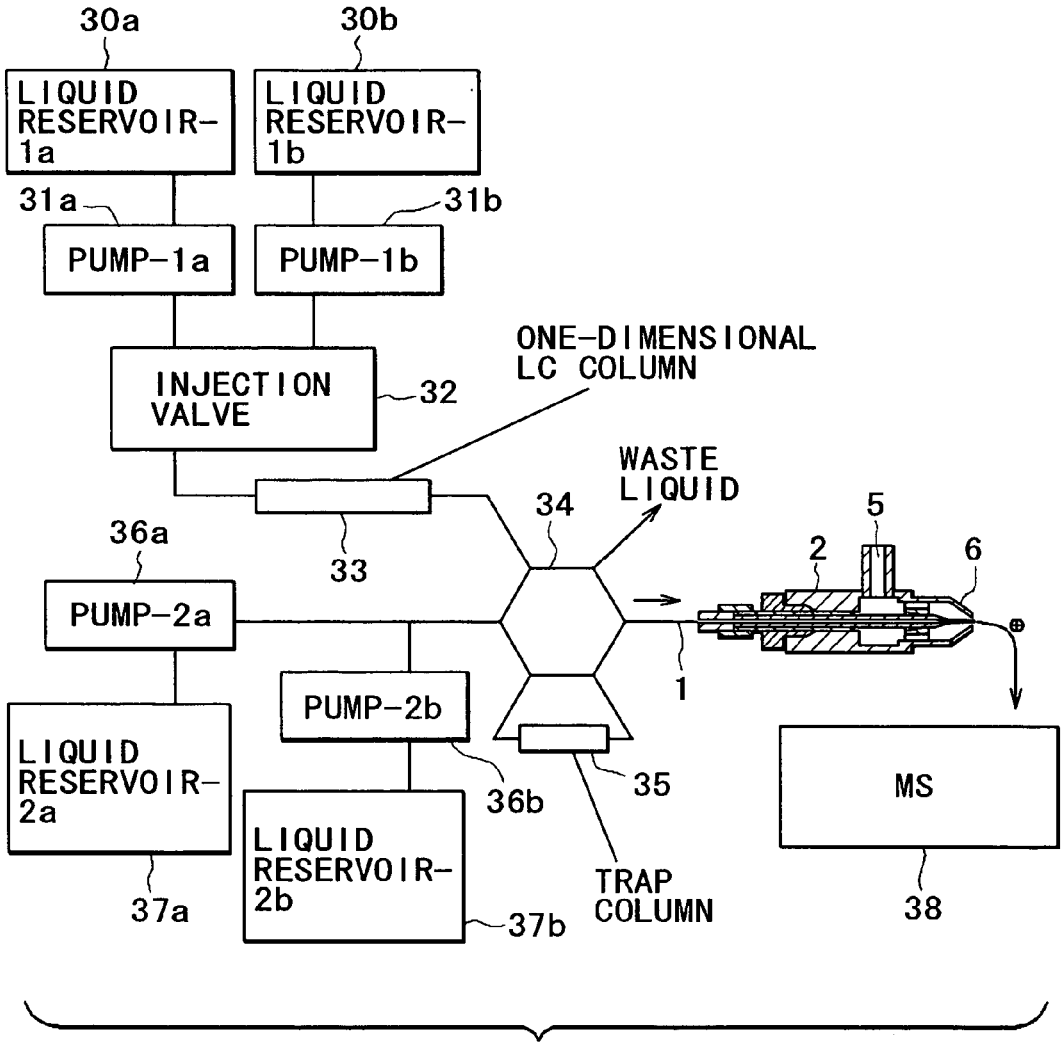
FIG. 7 is a block diagram showing a preferred embodiment of a liquid chromatograph/mass spectrometry (LC/MS) system using the mass spectrometer of the present invention.

FIG. 7 is a block diagram showing a preferred construction example of a liquid chromatograph/mass spectrometry (LC/MS) system using the mass spectrometer of the present invention. Liquids provided in liquid reservoirs -1*a* and -1*b* (30*a*, 30*b*) are mixed by means of LC pumps -1*a* and -1*b* (31*a*, 31*b*) and introduced at a constant flow rate into a one-dimensional LC column 33.

With an injection valve 32, the mixed sample solution comprising many kinds of substances of μL or so is introduced into the first-dimensional LC column 33 and is separated therein. But in the case of a mixed solution comprising many kinds of substances, the separation is incomplete. The mixed sample solution thus having been subjected to separation passes through a six-way valve 34 and is adsorbed in a trap column 35.

Next, the six-way valve 34 switches at a predetermined timing and other liquids provided in liquid reservoirs -2*a* and -2*b* (37*a*, 37*b*) are introduced into the trap column by means of LC pumps -2*a* and -2*b* (36*a*, 36*b*), causing the mixed sample adsorbed in the trap column 35 to be desorbed, which mixed sample is then introduced into the capillary 1 which is reduced in both outside and inside diameters at the first end 1*a* thereof. The capillary 1 is beforehand packed with packing beads for separation or is formed with a monolithic column, thus permitting separation of the mixed sample introduced therein. (the second-dimensional LC)

If the flow rate of liquid introduced into the capillary 1 is decreased, it is possible to obtain a higher separation capacity, which is extremely effective in the separation and analysis of a complicated mixture. A typical liquid flow rate is 200 nL/min. The adoption of a lower flow rate of 50 nL/min or so is also practical. As shown in FIG. 5 or 6 referred to earlier, the gaseous ions produced from the tip of the capillary 1 are introduced into a mass spectrometer (MS) 38 and are analyzed therein. The liquid chromatograph/mass spectrometry (LC/MS) system using the mass spectrometer of the present invention is effective particularly in the analysis of a mixed peptide solution obtained by subjecting a mixed protein solution extracted from a living body to enzyme digestion.

According to the present invention, it is possible to realize a spray ionization interface (ion source) suitable for the ionization of a low flow rate liquid, a mixed solution of trace biosubstances extracted from a living body can be analyzed at high speed and high sensitivity, and there can be realized a mass spectrometer of high sensitivity suitable for proteomics which analyzes proteins in a comprehensive manner. Moreover, according to the present invention, charged particles produced by spray are prevented from being introduced into a vacuum device in the mass spectrometer together with ions and, therefore, it is possible to prevent contamination of electrodes, etc. installed in the interior of the vacuum device. Further, at the time of detecting ions, it is possible to prevent charged particles from being detected as spike noises, which make peak determination difficult.

The foregoing invention has been described in terms of preferred embodiments. However, those skilled in the art will recognize that many variations of such embodiments exist. Such variations are intended to be within the scope of the invention and the appended claims.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiment-s and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. An ion source comprising:

a capillary, wherein a liquid sample is introduced into a second end of the capillary;

a gas guide tube having a first end into which the first end of the capillary is inserted, the gas guide tube guiding gas to flow along an outer periphery of the capillary and spray the liquid sample from the first end of the capillary; and a capillary holding member which is provided inside of said gas guide tube and outside of said capillary defining a tapered aperture into which the capillary is inserted; wherein the first end of the gas guide tube has a reduced inside diameter and a diameter of the tapered aperture is gradually reduced to a direction of the first end of the capillary.

2. An ion source according to claim 1 wherein the length of a tip portion of the first end of the gas guide tube is between 0.1 mm to 2 mm, wherein said tip portion has the smallest inside diameter compared with any other portion of the gas guide tube.

3. An ion source according to claim 1 wherein the first end of the capillary extends less than 2 mm beyond the end of the gas guide tube.

4. A mass spectrometric apparatus comprising:

an ion source comprising a capillary having a first end having reduced outside and inside diameters wherein a liquid sample is introduced into a second end of the capillary, a gas guide tube having a first end into which the first end of the capillary is inserted, the gas guide tube guiding gas so as to flow along an outer periphery of the capillary and spray the liquid sample from the first end of the capillary;

a capillary holding member which is provided inside of said gas guide tube and outside of said capillary defining a tapered aperture into which the capillary is inserted; and a mass spectrometer for performing mass separation on the icons generated by the ion source; wherein the first end of the gas guide tube has a reduced inside diameter and a diameter of the tapered aperture is gradually reduced to a direction of the first end of the capillary.

5. A mass spectrometric apparatus according to claim 4 wherein an ion intake port of the mass spectrometer is disposed outside a conical beam of charged particles generated from by ion source.

6. A mass spectrometric apparatus according to claim 4 wherein an ion intake port of the mass spectrometer is disposed outside a cone emanating from the first end of the capillary and which has an angle of 15° relative to a central axis of the capillary.

7. A mass spectrometric apparatus according to claim 4 wherein the angle between a central axis of the capillary and that of the ion intake port is greater than about 15°.

8. A mass spectrometric apparatus according to claim 4 wherein the angle between a central axis of the capillary and that of the ion intake port is about 90°.

9. A mass spectrometric apparatus according to claim 4 wherein the angle between a central axis of the capillary and that of the ion intake port is greater than about 15° and less than about 130°.

10. A mass spectrometric apparatus according to claim 4 wherein the length of a tip portion of the gas guide tube is between about 0.1 mm to about 2 mm, wherein said tip portion has the smallest inside diameter compared with any other portion of the gas guide tube.

11. A mass spectrometric apparatus according to claim 4 further comprising a gas introducing section and a gas supply section wherein pressure of the gas in the gas supply section connected to the gas introducing section is between about 2 atmospheres to about 10 atmospheres.

12. A mass spectrometric apparatus according to claim 4 wherein a value of a parameter F/S is in the range of 350 to 1000 m/s, the parameter F/S being determined by both a cross section S of the gas flow orthogonal to the gas flowing direction of a tip portion of the gas guide tube, wherein said tip portion has the smallest inside diameter compared with any other portion of the gas guide tube, and a flow rate F of the gas which is fed to the gas introducing section from a gas supply section.

13. A mass spectrometric apparatus according to claim 4 further comprising a gas introducing section, a gas supply section and a gas pressure gauge, which measures the pressure of the gas, fed to the gas introducing section from the gas supply section.

14. A mass spectrometric apparatus according to claim 4 further comprising a gas introducing section, a gas supply section and a gas flow controller for controlling flow rate of the gas fed to the gas introducing section from the gas supply section.

15. A mass spectrometric apparatus according to claim 4 further comprising a gas introducing section, a gas supply section and a gas valve for controlling pressure of the gas fed to the gas introducing section from the gas supply section.

16. A mass spectrometric apparatus according to claim 5 wherein said inner diameter of said first end of the capillary gradually reduces in size in a direction of gas flow.

17. A mass spectrometric apparatus according to claim 4 wherein the first end of the capillary extends less than 2 mm beyond the end of the gas guide tube.

18. An ion source according to claim 1 wherein said inner diameter of said first end of the capillary gradually reduces in size in a direction of gas flow.

* * * * *

UNITED STATES PATENT AND TRADEMARK OFFICE

CERTIFICATE OF CORRECTION

PATENT NO. : 7,141,788 B2
APPLICATION NO. : 10/975406
DATED : November 28, 2006
INVENTOR(S) : Hirabayashi et al.

It is certified that error appears in the above-identified patent and that said Letters Patent is hereby corrected as shown below:

Title Page Item (75):

Please add the name Hideki Hasegawa, Tachikawa (JP) as the third inventor

Signed and Sealed this

Sixteenth Day of June, 2009

JOHN DOLL
*Acting Director of the United States Patent and Trademark Office*